US006994301B1

(12) United States Patent
Fox

(10) Patent No.: US 6,994,301 B1
(45) Date of Patent: Feb. 7, 2006

(54) LEAF BAGGER

(76) Inventor: Thomas J. Fox, 2513 Early Ct., Virginia Beach, VA (US) 23454

( * ) Notice: Subject to any disclaimer, the term of this patent is extended or adjusted under 35 U.S.C. 154(b) by 0 days.

(21) Appl. No.: 10/820,012

(22) Filed: Apr. 8, 2004

Related U.S. Application Data

(60) Provisional application No. 60/461,834, filed on Apr. 11, 2003.

(51) Int. Cl.
*A63B 55/04* (2006.01)

(52) U.S. Cl. ..... 248/97; 248/99; 248/150; 248/154; 211/85.15; 383/33

(58) Field of Classification Search ..... 248/95, 248/97, 99, 100, 101, 150, 154; 224/925; 383/33, 34, 34.1; 211/85.15
See application file for complete search history.

(56) References Cited

U.S. PATENT DOCUMENTS

| | | | | | |
|---|---|---|---|---|---|
| 2,363,699 | A | * | 11/1944 | Smith | 248/97 |
| 3,502,291 | A | * | 3/1970 | Ackerman et al. | 248/97 |
| 3,638,888 | A | | 2/1972 | Ross | 248/97 |
| 4,174,085 | A | * | 11/1979 | Ferreira et al. | 248/97 |
| 4,188,005 | A | * | 2/1980 | Lee | 248/97 |
| 4,318,520 | A | * | 3/1982 | Walker | 248/97 |
| 5,169,101 | A | * | 12/1992 | Wenzel et al. | 248/97 |
| 5,251,925 | A | * | 10/1993 | Haley, Sr. | 280/641 |
| 5,263,672 | A | * | 11/1993 | He | 248/97 |
| 5,411,229 | A | | 5/1995 | Hoefkes | 248/97 |
| 6,076,782 | A | | 6/2000 | Alderman | 248/97 |
| 6,511,110 | B2 | | 1/2003 | Roye | 294/1.1 |

FOREIGN PATENT DOCUMENTS

| | | | | |
|---|---|---|---|---|
| CH | 13656 | * | 7/1897 | 248/97 |
| GB | 705287 | * | 3/1954 | 248/97 |
| GB | 1494835 | * | 12/1977 | 248/101 |
| GB | 2177996 | * | 2/1987 | 248/97 |

* cited by examiner

*Primary Examiner*—Jonathon Szumny
(74) *Attorney, Agent, or Firm*—Patent & Trademark Services, Inc.; Joseph H. McGlynn

(57) ABSTRACT

A collapsible support frame having two side members attached to each other by at least one hinge and a retention ring which when placed on the side members secures a bag to the support frame in an open position. The two side members pivot with respect to each other to a preferred angle and the retention ring holds the side members together at the preferred angle. The support frame can be placed either upright or laid on the ground allowing the user to insert items in the bag in an easy fashion.

10 Claims, 3 Drawing Sheets

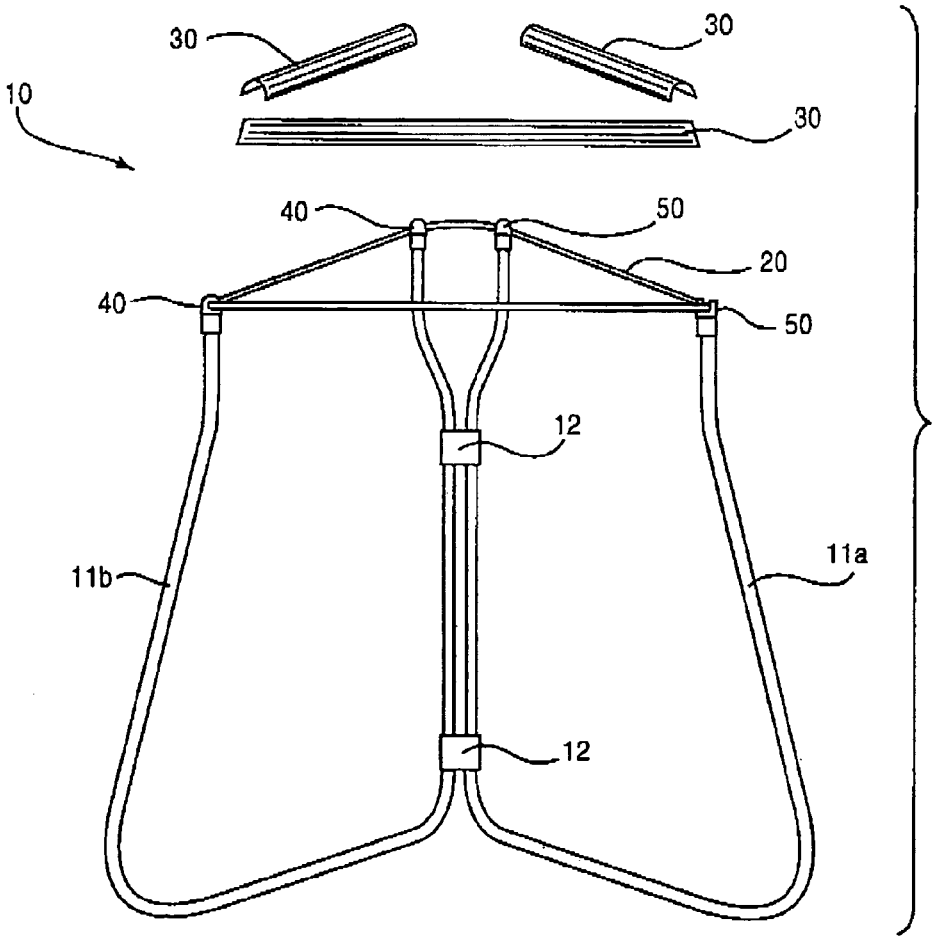
FIG.1 Amended

LEAF BAGGER

Applicant claims priority of Provisional Ser. No. 60/461,834, filed Apr. 11, 2003.

BACKGROUND OF THE INVENTION

This invention relates, in general, to a support frame, and, in particular, to an improved support frame for use with leaf bags or the like.

DESCRIPTION OF THE PRIOR ART

In the prior art, various types of bag retainers have been proposed. For example, U.S. Pat. No. 6,511,110 to Roye discloses a bag retainer with a plurality of legs, which are joined to a bag-retaining frame having retainers to hold a bag in the frame.

U.S. Pat. No. 6,076,782 to Alderman discloses a bag retainer with a plurality of legs joined to a bag-retaining frame having retainers to hold a bag in the frame.

U.S. Pat. No. 3,638,888 to Ross discloses a foldable bag frame with a lower and upper support ring and supports between the support rings.

U.S. Pat. No. 5,411,229 to Hoefkes discloses a bag holder with two frames that are hinged together to support a bag therebetween.

In contrast to the prior art references, the present invention is a support apparatus for holding a bag in an open condition having a side frame which snaps onto an upper bag retention frame and retainers securing the bag to the retention frame.

SUMMARY OF THE INVENTION

The present invention is a support apparatus for holding a bag in an open condition. The support has a side frame which snaps onto an upper bag retention frame and retainers securing the bag to the retention frame.

It is an object of the present invention to provide a new and improved support apparatus for holding a bag in an open condition.

It is an object of the present invention to provide a new and improved support apparatus that is easy to use.

It is an object of the present invention to provide a new and improved support apparatus that is lightweight.

These and other objects and advantages of the present invention will be fully apparent from the following description, when taken in connection with the annexed drawings.

BRIEF DESCRIPTION OF THE DRAWINGS

The above and other advantages and features of the present invention will be better understood from the following detailed description of the preferred embodiments of the present invention, which is provided in connection with the accompanying drawings. The various features of the drawings may not be to scale. Included in the drawing are the following figures:

FIG. 1 is an exploded perspective view of the present invention.

DESCRIPTION OF THE PREFERRED EMBODIMENT

Figure 3:
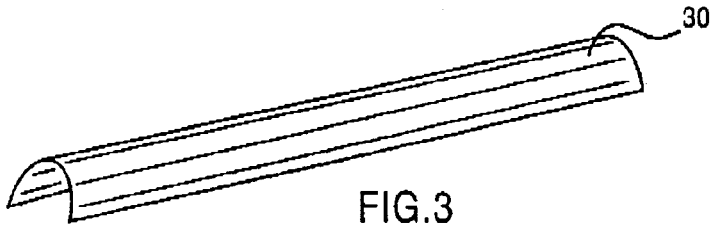
FIG. 3 is a perspective view of one of the retainers of the present invention.

In the prior art, there are many bag holders, but these prior art bag holders have numerous deficiencies. For example, prior art bag holders may be inconvenient to erect, may collapse at inopportune times and may be unstable when the bag is filled.

Referring to the drawings in greater detail, FIG. 1 illustrates the present invention 10 in an upright position having vertical side members 11*a* and 11*b*, at least one hinge 12, upper retention member 20, at least one retainer 30 and connectors 40 and 50. While FIG. 1 illustrates the present invention 10 having two side members 11*a* and 11*b* whereby the present invention 10 is substantially trapezoidal in shape, any shape or number of side members could be utilized without departing from the scope of the present invention 10.

Side frames 11*a* and 11*b* are elongated members having at least two ends wherein side members 11*a* and 11*b* are, preferably, tubular in form and substantially U-shaped. In this preferred embodiment, it is to be understood that the base of the "U" rests on a surface such as the ground, thereby adding greater stability to the present invention 10 since its base is broad. In other embodiments, side members 11*a* and 11*b* can be any shape well known within the art and can be constructed using a variety of materials such as but not limited to metal, plastic, fiberglass or the like.

Side members 11*a* and 11*b* are attached to each other by at least one hinge 12 which enable side members 11*a* and 11*b* to pivot around a vertical axis. This allows a user to open or close the present invention 10 for use or storage. Hinge 12 is any conventional hinge well known in the art. It should be appreciated when the user closes the present invention 10, side members 11*a* and 11*b* lie on top of each other.

Figure 10:
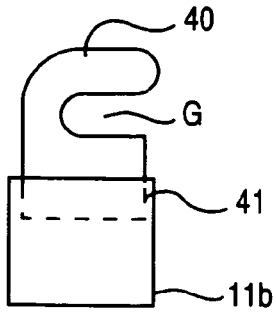
FIG. 10 is a partial view of one of the connectors of the present invention engaged with one of the side members.

Connectors 40 and 50 (see also FIGS. 4, 5) are attached to the upper end or tip of side members 11*a* and 11*b* by any means well known within the art. For example, side members 11*a* and 11*b* are elongated, hollow members and connectors 40 and 50 could be inserted within the hollow cavity (see FIG. 10). While connectors 40 and 50 are shown attached to the tips of side members 11*a* and 11*b* by any means well known in the art, it would not be a departure from the scope of the present invention 10 to utilize other variations or embodiments such as making connectors 40 and 50 and side members 11*a* and 11*b* of one piece, unitary construction.

Retention ring 20 attaches to connectors 40, 50 by means of a snap connection. The outer diameter of the ring 20 is substantially the same dimension or slightly less than the dimension of the dimension of the slot G (see FIGS. 4, 5). This allows the triangular ring 20 to be forced into the slot G to retain the ring on the connectors 40, 50. When the present invention 10 is in use, it is to be understood that at least a portion of the retention ring 20 rests on or within connector 50 stabilizing the retention ring 20 and substantially holding the retention ring 20 in place limiting its movement. The only substantial difference between connector 40 and connector 50 is the slot G in connector 40 extends horizontally, and the slot G in connector 50 extends vertically. The present invention 10 also features retainer 30 which will be described later in greater detail.

Figure 2:
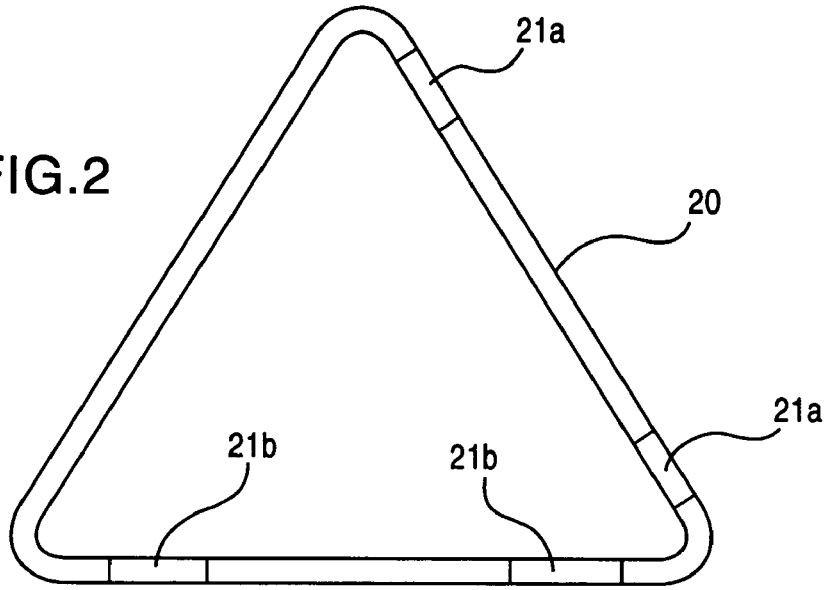
FIG. 2 is a top view of the retention ring of the present invention.
Figure 2A:
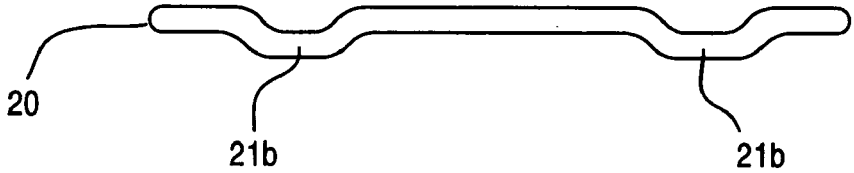
FIG. 2*a* is a side view of the retention ring of the present invention.

FIGS. 2 and 2*a* illustrates the retention ring 20 in greater detail. Retention ring 20 is substantially triangular in shape. The retention ring 20 can be constructed of zinc coated steel wire. The retention ring 20 has, preferably, four offset portions 21*a*, 21*b* substantially corresponding to the locations of connectors 40 and 50. The offset portions 21*a*, 21*b* are offset from the longitudinal axis of the sides of the ring 20 by a predetermined distance as shown in FIG. 2*a*. The offsets 21*b* will be snapped into the horizontal slots G in connectors 40, and then the ring 20 will be rotated down until the offsets 21*a* snap into the vertical slots G in connectors 50.

FIG. 3 illustrates the retainer 30 in greater detail. The retainer 30 is an elongated, concave member having two ends. The internal diameter of the concave portion of retainer 30 fits snugly over the straight sections of the retention ring 20. When a bag is interposed between the ring 20 and the retainers 30, and retainers 30 are forced onto the ring 20 the bag 90 (see FIG. 9) will be held securely to the retention ring 20. Retainers 30 can be made from various materials such as, but not limited to, extruded plastic or high-density polyethylene.

Figure 4:
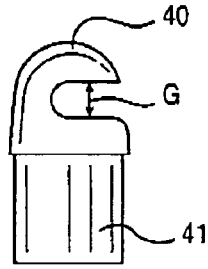
FIG. 4 is a side view of one of the connectors of the present invention.

FIG. 4 is a detailed view of connector 40. As described above, connectors 40 attach to side frame 11*b* by any means well known within the art, or connector 40 and side frame 11*b* could be a one piece, unitary construction. In the preferred embodiment, the bottom portion 41 of connectors 40 fits within the ends of side frame 11*b* (see FIG. 10). The protrusion on the connector 40 is substantially circular in shape and its diameter is about the same as the inner diameter of side frame 11*b*. While the preferred embodiment of the protrusion is described as being substantially circular in shape, other variations and embodiments can exist wherein the protrusion can be any shape well known within the art as long as the shape of the protrusion is substantially similar to the inside shape of the side frame 11*b*.

Connector 40 features a substantially horizontal groove G, wherein the size of the groove is similar to the outer diameter of the offset point 21*b* of the retention ring 20. Offset point 21*b* attaches to connector 40 by any means well known in the art. In the preferred embodiment, connector 40 is releasably attached to retention ring 20, however retention ring 20 can be permanently attached to connector 40 during the manufacture of the present invention 10, as long as the ring is allowed to pivot with respect to the connector. Either embodiment must allow the retention ring 20 to rotate around the axis created by the connection of the retention ring 20 to connector 40.

Figure 5:
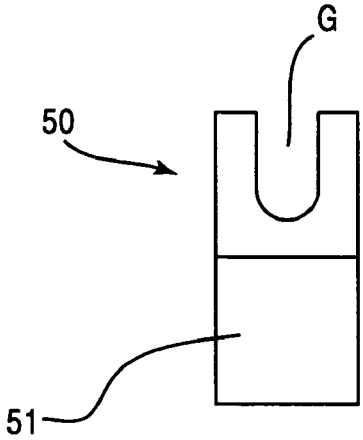
FIG. 5 is a side view of another connector of the present invention.

FIG. 5 is a detailed view of connector 50. As described above, connector 50 attaches to side frame 11*a* in the same manner as connector 40 and side frame 11*b*. Protrusion 51 on the connector 50 is substantially circular in shape and its diameter is about the same as the inner diameter of the side frame 11*a*. While the preferred embodiment of the protrusion 50 is described as being substantially circular in shape, other variations and embodiments can exist wherein protrusion 51 can be any shape well known within the art as long as the shape of the protrusion is substantially similar to the inside shape of the side frame 11*a*.

Connector 50 features a groove G that is substantially vertical. The size of the groove is similar to the outer diameter of the offset point 21*a* of the retention ring 20. As the retention ring 20 rotates in a clockwise direction, offset point 21*a* will come to rest within groove G of the connector 50. Since connectors 40 and 50 engage the retention ring 20 at the offset points 21*a* and 21*b*, no substantial movement occurs along the length of the retention ring 20 and this system creates a rigid lightweight assembly wherein the retention ring 20 is securely attached to side members 11*a* and 11*b*.

Figure 6:
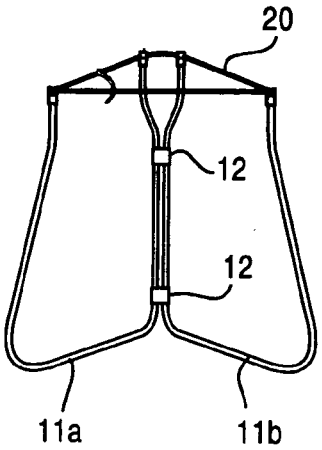
FIGS. 6–8 are front views showing the present invention in different stages.
Figure 7:
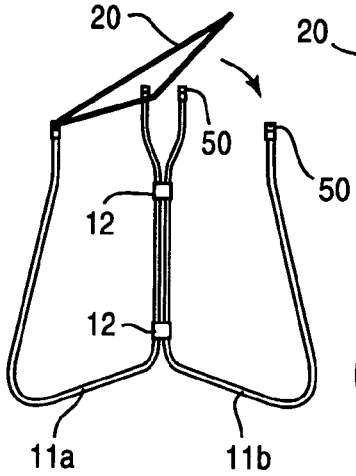
Figure 8:
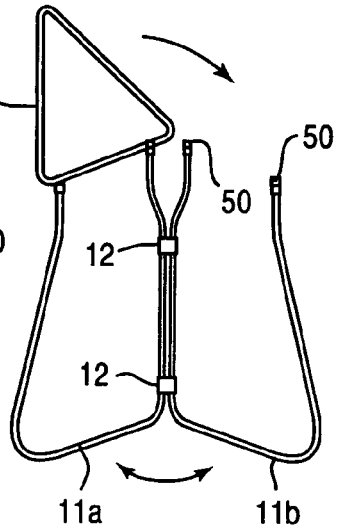

FIGS. 6–8 illustrate views of the present invention 10 at various stages of assembly. To erect the present invention 10 for use, side members 11*a* and 11*b* are opened to a first angle as shown in FIG. 8. Retention ring 20, by means of its connection to side frame 11*a* via connector 40, rotates in a clockwise direction as shown in FIGS. 7, 8 until retention ring 20 engages the vertical groove G in connector 50, as described above. Once the offset points 21*a* of the retention ring 20 engage the vertical grooves in connectors 50, the retention ring 20 is secured in place as shown in FIG. 6. Since connectors 40 and 50 engage the retention ring 20 at the offset points 21*a*, 21*b*, no substantial movement occurs along the length of the retention ring 20 and this system creates a rigid lightweight assembly wherein the retention ring 20 is securely attached to side members 11*a* and 11*b*.

Figure 9:
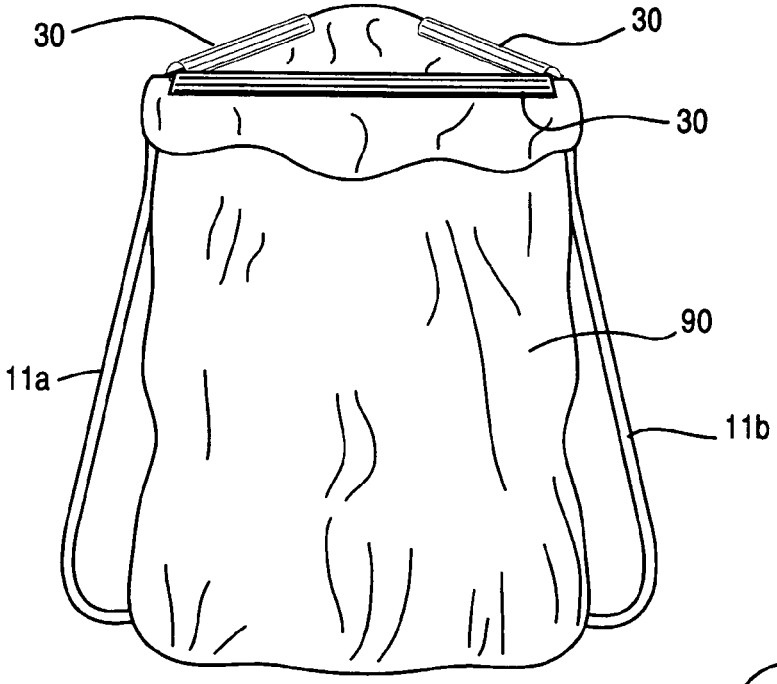
FIG. 9 is a view of the present invention with a bag attached.

FIG. 9 shows a bag attached in the present invention 10. To use the present invention 10, an open bag 90 is inserted through the top of the retention frame 20. It is to be understood that the present invention 10 is to be used with bags having an outer circumference slightly greater than the perimeter of the retention frame 20. A predetermined length of the bag 90 is pulled over the retention frame 20, preferably two inches. The retainers 30 are placed over the retention frame 20 securing the bag 90 to the retention frame 20.

The bag 90 is now secured to the present invention 10 and the bag 90 can easily be filled by dropping items through the opening in the bag 90. Alternatively, the present invention 10 can be tipped forward so that one of the side frames 11*a*, 11*b* is on the ground. In this position, the shape of the side frames 11*a* and 11*b* and retention ring 20 ensures that the present invention 10 remains as close to the ground as possible. Items can be easily moved into the horizontal bag 90 though the wide opening defined by the retention ring 20. When the bag 90 is full, the present invention 10 can be easily moved into its upright position.

In the upright position, as shown in FIG. 9, the shape and angles of the side members 11*a* and 11*b* enable the bag 90 to be filled completely without touching the side members 11*a* and 11*b*. To remove the bag 90 from the present invention 10, retainers 30 are removed and the top of the bag 90 is tied in a conventional manner. The user then grasps the retention ring 20 or other elements of the present invention 10 and lifts the present invention 10 over the bag 90. This allows the user to move the present invention 10 and not the bag 90 since the bag 90 could be relatively heavy due to the items placed within.

Although the Leaf Bagger and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim my invention is:

1. A support frame for holding a bag in an open position, said support frame comprising:

a first side frame and a second side frame, each said side frame having a base, a first side connected to one side of said base and a second side connected to another side of said base, and hinge means for allowing said first and second side frames to pivot with respect to each other, and fixing means for holding said first and second side frames in an open fixed position with respect to each other, and retaining means for securing a bag to said fixing means, and wherein said fixing means comprises a triangular ring, and wherein said triangular ring has a plurality of offsets positioned thereon, and wherein said clips comprise two different types of clips, one of said clips having a slot with a horizontal opening, and another of said clips having a slot with a vertical opening, and said offsets are received in said slots.

2. A support frame for holding a bag in an open position, said support frame comprising:

a first side frame and a second side frame, means for allowing said first and second side frames to pivot with respect to each other, and means for holding said first and second side frames in position with respect to each other, and means for securing a bag to said means for holding said first and second side frame in position with respect to each other, and wherein each of said first and second side frames comprise two side portions and a base, and said side portions have a first end adjacent said base and a second end, means connected to said second end for securing said means for holding said first and second side frames in position with respect to each other, and wherein said means connected to said second end for securing said means for holding said first and second side frames in position with respect to each other comprise clips, and said clips having a first end connected to said second ends of said side portions, and said clips having a second end remote from said second ends of said side portions, said second end of said clips having means for receiving said means for holding said first and second side frames in position with respect to each other, and wherein said clips comprise two different types of clips, one of said clips having a slot with a horizontal opening, and another of said clips having a slot with a vertical opening.

3. The support frame as claimed in claim 2, wherein said means for securing a bag to said means for holding said first and second side frame in position with respect to each other comprise an elongated concave element.

4. The support frame as claimed in claim 2, wherein said means for receiving said means for holding said first and second side frames in position with respect to each other comprise slots in said second ends of said clips.

5. The support frame as claimed in claim 2, wherein said means for holding said first and second side frames in position with respect to each other comprises a triangular ring.

6. The support frame as claimed in claim 5, wherein said triangular ring has a plurality of offsets positioned thereon.

7. The support frame as claimed in claim 6, wherein there are two different types of clips, one of said clips having a slot with a horizontal opening, and another of said clips having a slot with a vertical opening, and said offsets are received in said slots.

8. A support frame for holding a bag in an open position, said support frame comprising:

a first side frame and a second side frame, each said side frame having a base, a first side connected to one side of said base and a second side connected to another side of said base, and hinge means for allowing said first and second side frames to pivot with respect to each other, and fixing means for holding said first and second side frames in an open fixed position with respect to each other, and retaining means for securing a bag to said fixing means, and wherein said first and second sides of each side frame are hollow, and wherein a plurality of clips are inserted into said hollow first and second sides of each side frame, said clips receiving and holding said fixing means, and wherein said clips comprise two different types of clips, one of said clips having a slot with a horizontal opening, and another of said clips having a slot with a vertical opening.

9. The support frame as claimed in claim 8, wherein said fixing means comprises a triangular ring.

10. The support frame as claimed in claim 8, wherein said retaining means comprise an elongated concave element.

* * * * *